US011306963B2

(12) United States Patent
Lindel et al.

(10) Patent No.: US 11,306,963 B2
(45) Date of Patent: Apr. 19, 2022

(54) REFRIGERATION APPLIANCE WITH BUILT-IN PART

(71) Applicant: BSH HAUSGERAETE GMBH, Munich (DE)

(72) Inventors: Andreas Lindel, Heidenheim (DE); Felix Wiedenmann, Oepfingen (DE); Markus Arbogast, Herbrechtingen (DE); Bernd Wolfsteiner, Huettlingen (DE)

(73) Assignee: BSH Hausgeraete GmbH, Munich (DE)

( * ) Notice: Subject to any disclaimer, the term of this patent is extended or adjusted under 35 U.S.C. 154(b) by 290 days.

(21) Appl. No.: 16/571,697

(22) Filed: Sep. 16, 2019

(65) Prior Publication Data

US 2020/0096249 A1 Mar. 26, 2020

(30) Foreign Application Priority Data

Sep. 25, 2018 (DE) ..... 20 2018 004 467.9

(51) Int. Cl.
*F25D 23/06* (2006.01)
*F25D 23/00* (2006.01)
*A47B 96/04* (2006.01)

(52) U.S. Cl.
CPC ..... *F25D 23/006* (2013.01); *A47B 96/04* (2013.01)

(58) Field of Classification Search
CPC ..... F25D 23/006; A47B 96/04
See application file for complete search history.

(56) References Cited

U.S. PATENT DOCUMENTS

| | | | | |
|---|---|---|---|---|
| 8,850,839 | B2 * | 10/2014 | Park | F25D 17/062 62/262 |
| 10,254,037 | B2 * | 4/2019 | Candeo | F25D 17/062 |
| 10,337,774 | B2 * | 7/2019 | Arbogast | F25D 23/006 |
| 2012/0047934 | A1 * | 3/2012 | Park | F25D 25/024 62/264 |
| 2017/0363335 | A1 * | 12/2017 | Arbogast | F25D 23/006 |

FOREIGN PATENT DOCUMENTS

| | | | | |
|---|---|---|---|---|
| DE | 102016210707 | A1 | 12/2017 | |
| WO | WO-2010115691 | A2 * | 10/2010 | F25D 23/067 |

* cited by examiner

*Primary Examiner* — Kimberley S Wright
(74) *Attorney, Agent, or Firm* — Laurence A. Greenberg; Werner H. Sterner; Ralph E. Locher

(57) ABSTRACT

A refrigeration appliance contains an inner container delimiting an interior and having an opening, a first reinforcement part anchored to in the opening of the inner container and has a screw hole and extends in an axial direction, and at least one coupling part. A built-in part is disposed in the interior and has an opening. The built-in part is fastened by the at least one coupling part pushing through the opening of said built-in part in an axial direction and engages into the first reinforcement part. The first reinforcement part has a side facing toward the interior and on the side facing toward the interior has an atrium, a cross-section of the atrium being greater than that of the screw hole. The coupling part has a peg, a cross-section of the peg being greater than that of the screw hole and the peg engages into the atrium.

15 Claims, 4 Drawing Sheets

FIG. 3
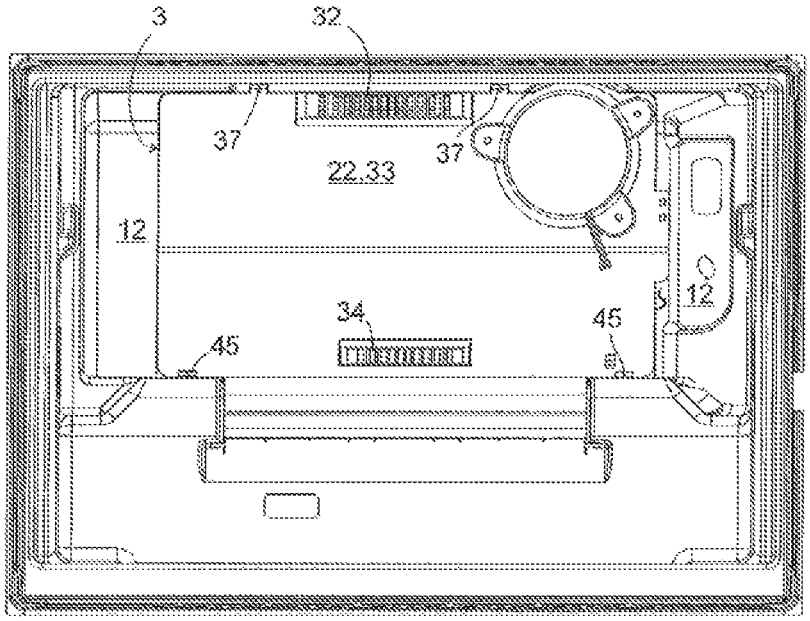
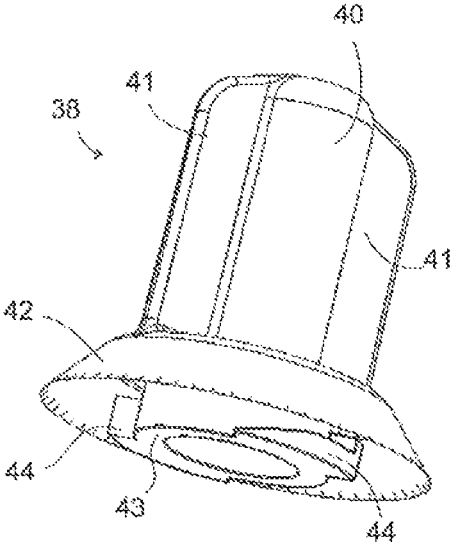
FIG. 4
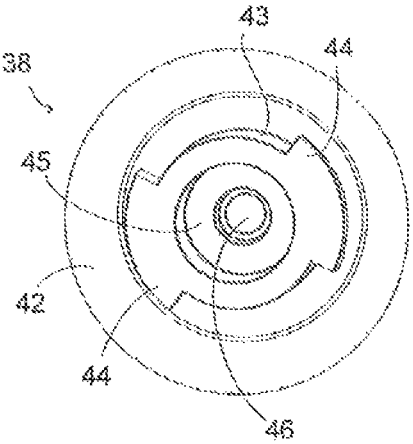
FIG. 5

FIG. 9
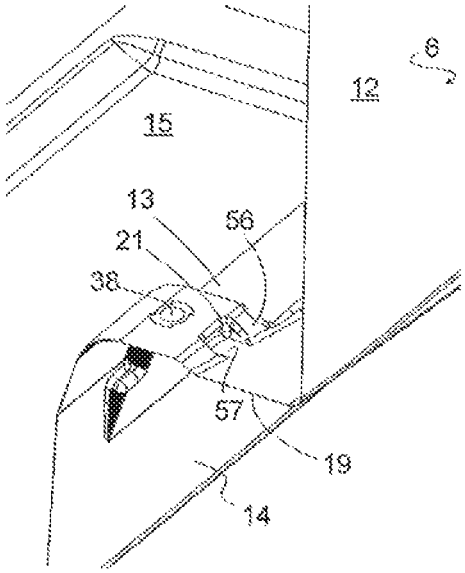
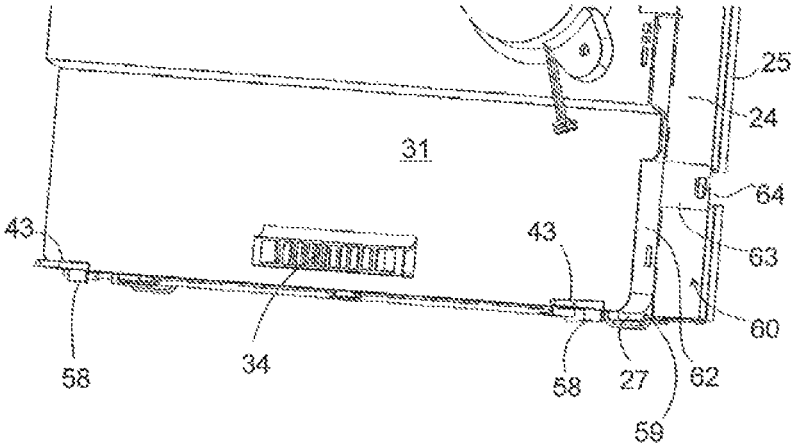
FIG. 10

REFRIGERATION APPLIANCE WITH BUILT-IN PART

CROSS-REFERENCE TO RELATED APPLICATION

This application claims the priority, under 35 U.S.C. § 119, of German application DE 20 2018 004 467.9, filed Sep. 25, 2018; the prior application is herewith incorporated by reference in its entirety.

BACKGROUND OF THE INVENTION

Field of the Invention

The present invention relates to a refrigeration appliance, in particular a household refrigeration appliance such as a refrigerator, a freezer or a combined fridge-freezer, with an inner container which delimits an interior of the refrigeration appliance, and a built-in part anchored in the interior.

The inner container of a refrigeration appliance of this kind is conventionally deep-drawn from a thermoplastic material and may comprise one or more protrusions, in order to form various temperature-controlled storage compartments such as a normal refrigerator compartment and a freezer compartment; alternatively, a contiguous protrusion may be divided by a built-in part into a plurality of storage compartments and/or into a storage compartment and an evaporator compartment.

The inner container is usually connected by an outer membrane to a hollow housing, the hollow space of which is foamed with synthetic resin, in order to form an insulation layer between the interior and the surrounding environment.

In order to be able to install built-in parts in the interior, it is further known to install reinforcement parts at openings cut into the inner container, to which a built-in part can be screwed, and which on the one hand tightly cover the openings of the inner container, in order to prevent a penetration of the synthetic resin to be foamed into the interior, and on the other hand achieve a load carrying capacity which is sufficient for the built-in part by engaging into the solidified insulation layer.

In order to be able to manufacture various models of refrigeration appliances in a streamlined manner, it is favorable to be able to use as many identical components as possible in all models. This is particularly problematic for large-format components such as housing for an evaporator compartment, for example. In order to install a uniform housing on a rear wall of an inner container of a width which is variable in a model-dependent manner, it would be simplest per se to screw the housing directly onto the rear wall; however, the reinforcement parts engaging into the insulation layer of the rear wall then form undesirable points of weak thermal insulation.

SUMMARY OF THE INVENTION

One object of the invention is to create a refrigeration appliance with a built-in part, in which a risk of leakage of the inner container due to the installation of the built-in part is reduced.

The object is achieved in that, in a refrigeration appliance with an inner container delimiting an interior has a first reinforcement part which is anchored to an opening of the inner container and with a screw hole extending in an axial direction, and a built-in part which is arranged in the interior and is fastened by at least one coupling part pushing through an opening of the built-in part in an axial direction and engaging into the first reinforcement part. The reinforcement part on its side facing toward the interior has an atrium, the cross-section of which is greater than that of the screw hole, and that the coupling part comprises a peg, the cross-section of which is greater than that of the screw hole and which engages into the atrium.

According to a first embodiment of the invention, in addition to the coupling part, there may be provision for a screw, which engages into the screw hole, as described in greater detail below.

According to a second embodiment, the engagement of the peg into the atrium may already be sufficient to fasten the built-in part, in particular if the inner container has wall areas which are suitably oriented for this purpose, as likewise described in more detail below.

In the case of the first embodiment, the coupling part is to have a through-hole, which is flush with the screw hole when the peg is introduced into the atrium, so that a screw, if introduced into the through-hole, is guided into the screw hole.

The diameter of through-hole and screw hole are to be chosen such that a screw, which can be screwed into the screw hole, can be pushed through the through-hole freely and without engaging with the thread.

In both embodiments, the coupling part is fixed to the opening of the built-in part, preferably such that it cannot move in the axial direction. It is thus possible to prevent the coupling part from falling out of the opening before the screw can be put in position; in the case of the second embodiment, the axial fixing is useful for ensuring a permanent form fit between the inner container and the built-in part.

The axial fixing can be achieved on the one hand by a resilient latching tongue of the peg.

On the other hand, the coupling part is to comprise a flange, the cross-section of which is greater than that of the peg, in order to prevent the complete coupling part passing the opening of the built-in part.

The inner container preferably contains a first wall area, with which the built-in part is in contact, and a second wall area angled away from the first wall area, to which the first reinforcement part is anchored. Thus, as already explained above, a weakness in the insulation layer behind the first wall area can be avoided.

In order to enable a convenient installation of the built-in part, the first and the second wall areas should form an obtuse angle.

For anchoring the built-in part, it is further helpful if the inner container has a third wall area opposite the second wall area, and the built-in part is in contact with the second and the third wall areas.

Anchored to the third wall area is a second reinforcement part, to which the built-in part is likewise fastened.

According to a preferred application, the built-in part contains a housing of an evaporator chamber. With the aid of the reinforcement part and the coupling part, however, it is also possible for any other possible built-in parts to be anchored.

The housing of the evaporator chamber should, in order to offer space for a—typically cuboid-shaped—evaporator, comprise at least one end wall, which extends in parallel with a wall region of the inner container.

In order to enable a use of the housing in refrigeration appliances of different widths, the housing should further comprise at least one side wall angled away from the end wall, of which the edge facing away from the end wall is in contact with the inner container.

In order to ensure a sealed connection of the edge at the inner container, a resilient seal is to be compressed between the edge and the inner container.

In order to secure accessibility of the opening of the built-in part, the opening of the built-in part can be formed in a tab protruding from an edge of the end wall.

Other features which are considered as characteristic for the invention are set forth in the appended claims.

Although the invention is illustrated and described herein as embodied in a refrigeration appliance with built-in part, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 3 is a front view of the evaporator housing installed on a rear side of a storage chamber, here a freezer compartment, of the refrigeration appliance from FIG. 1;

FIG. 4 is a perspective view of a reinforcement part;

FIG. 5 is a second perspective view of the reinforcement part;

FIG. 9 is a perspective view of a detail of an inner container of the storage chamber; and FIG. 10 is a partial front view of the evaporator housing.

DETAILED DESCRIPTION OF THE INVENTION

Figure 1:
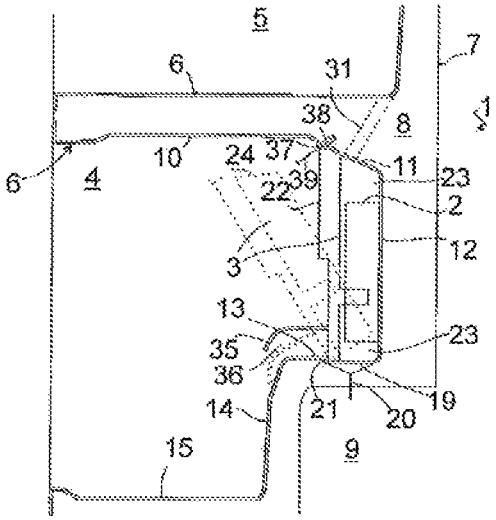
FIG. 1 is a diagrammatic, partial cross-sectional view through a household refrigeration appliance according to the invention.

Referring now to the figures of the drawings in detail and first, particularly to FIG. 1 thereof, there is shown a schematic section through a body or carcass 1, an evaporator 2 installed in the body 1 and an evaporator housing 3 according to the present invention. Two storage chambers 4, 5 are disposed in the body 1, typically a storage chamber 4 operated below freezing point and a storage chamber 5 (only partially shown in FIG. 1) operated above the freezing point. Both storage chambers 4, 5 are delimited in a per se known manner by an inner container 6 deep-drawn from plastic. A hollow space between the inner container 6 and a solid outer membrane 7 of the body 1 is foamed with insulation material 8 in a manner which is customary according to the prior art.

A machinery area recess 9 is provided on a rear side of the body 1, which offers space for a non-illustrated compressor and also possibly for a condenser and a fan.

The inner container 6 of the storage chamber 4 contains a cover 10, which, together with a base of the inner container 6 of the storage chamber 5, forms an intermediate wall between the storage chambers 4 and 5 filled with the insulation material 8, a chamfer 11 sloping out from the rear edge of the cover 10, a vertical wall area 12 or rear wall joining a rear edge of the chamfer 11, on which the evaporator 2, typically a fin evaporator, is installed, an approximately horizontal upper side 13 of the machinery area recess 9, a front side 14 of the machinery area recess 9, and also a base 15.

The chamfer 11, the vertical wall area 12 and the upper side 13 together delimit a recess on the rear side of the storage chamber 4, which is largely filled by the evaporator 2 and the evaporator housing 3. In the case of FIG. 1, the recess occupies the entire rear side of the storage chamber 4 above the upper side 13; according to one variant (not shown in the drawing), a vertical piece of the rear wall may extend between the rear edge of the cover and the chamfer, which runs parallel to the vertical wall area 12 below the chamfer 11, but is offset forward in parallel in relation thereto, however.

Figure 2:
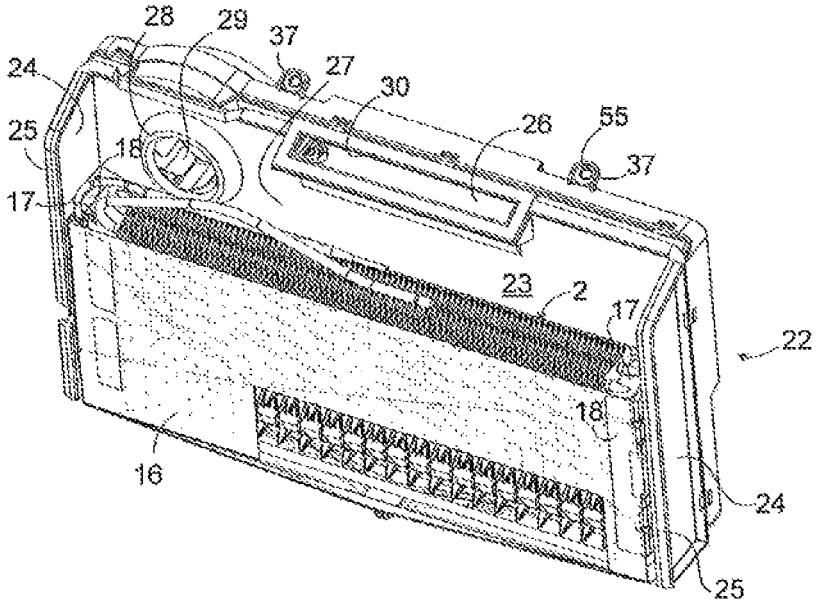
FIG. 2 is a perspective view of an evaporator and an evaporator housing of the refrigeration appliance from FIG. 1.

The evaporator 2 is anchored to the vertical wall area 12 with the aid of an installation element known from published, non-prosecuted German patent application DE 10 2016 210 707 A1, corresponding to U.S. Pat. No. 10,337,774. The installation element, as shown in FIG. 2, contains a base plate 16, which in the installed state is in contact with the vertical wall area 12 and opposite a width side of the evaporator 2, and also retaining webs 18, which protrude from the lateral edges of the base plate 16 and surround end faces of the evaporator 2 and bypass blockers 17 plugged into these (see FIG. 2).

A condensation drainage groove 19 is recessed below the evaporator 2 on the upper side 13. Running from the deepest point of the condensation drainage groove 19 is a passage 20 through the insulation material 8 of the cover 10, into the machinery area recess 9, in order to drain condensation water from the evaporator 2 to a non-illustrated evaporation pan in the machinery area recess 9.

On a side of the condensation drainage groove 19 facing away from the vertical wall area 12, a contact area 21 is formed which faces toward the vertical wall area 12 and is oriented vertically in a similar manner.

The evaporator housing 3 is shown in FIG. 1 in two different positions, once in the fully installed state with solid lines and once in a position occupied during its assembly with dashed lines. The evaporator housing 3 contains an end wall 22, which in the fully installed state extends from a condensation drainage groove 19 continuously through to the rear edge of the cover 10 and thus partitions an evaporator chamber 23 off from the storage chamber 4, and also side walls 24, which surround the evaporator 2 and the bypass blockers 17 laterally in each case and cling tightly to the vertical wall area 12 on both sides of the evaporator 11. As can be seen in FIG. 2, seals 25 are molded or adhesively bonded onto each of the edges of the side walls 24 facing away from the end wall 22, which seals 25, in the fully installed state, are compressed in tightly abutting contact with the chamfer 11 or the vertical wall area 12.

In a refrigeration appliance with a single storage chamber, the end wall 22 may be formed by a single wall, in which inlet and outlet openings are left for the air exchange with the storage chamber. In the case considered here of a refrigeration appliance with two storage chambers 4, 5, the end wall 22 is a hollow body with a distribution chamber 26 therein. Situated in a rear wall 27 of the distribution chamber 26 which faces toward the evaporator 2 is an opening 28, on which a fan 29 is arranged, in order to pump cold air from the evaporator chamber 23 into the distribution chamber 26. In FIG. 2, air blades of the fan 29 can be seen through the opening 28. Situated on the upper edge of the distribution chamber 26 is an outlet 30, a duct 31 (see FIG. 1) which extends through the chamfer 11 of the inner container 6 towards the storage chamber 5 joining here in the fully installed state. A further outlet 32 of the distribution chamber 26 is situated, as can be seen in FIG. 3, at the upper edge of a front wall 33 which extends between the distribution chamber 26 and the storage chamber 4. The outline of the fan 29 is shown on the front wall 33 as a circular projection.

An inlet 34, which leads below and through the distribution chamber 26 and directly into the evaporator chamber 23, is formed at the lower edge of the front wall 33. In the view of FIG. 3, the inlet 34 is shown as exposed; with the refrigeration appliance completely installed, the inlet 34 is hidden below a plate-shaped screen 35.

The screen 35 is shown in FIGS. 1 and 2. As can be seen in FIG. 1 in particular, it initially protrudes perpendicularly from the front wall 33 and then, via a front edge of the upper side 13, forms a downwardly curved arc, so that it delimits, together with the upper side 13, an air duct 36 drawing in from a lower region of the storage chamber 4.

When the evaporator housing 3 is assembled in the storage chamber 4, first, as shown by the dashed outline in FIG. 1, a lower edge of the end wall 22, to be more precise of the front wall 33 thereof, is introduced into the condensation drainage groove 19 and placed on the contact area 21. By way of subsequently pivoting about an axis running through the contact area 21 perpendicular to the sectional plane in FIG. 1, the free edges of the side walls 24 come into contact with the vertical wall area 12 and the chamfer 11 on both sides of the evaporator 2.

As can be seen in FIG. 2, screw tabs 37 protruding obliquely from the front wall 31 are formed along an upper edge of the front wall 33, which screw tabs 37, when the evaporator housing 3 is pivoted into the upright position drawn with solid lines in FIG. 1, are opposite reinforcement parts 38 on the rear edge of the cover 10. With the aid of screws 39 (see FIG. 1), which are screwed into the reinforcement parts 38 through openings in the screw tabs 37, the evaporator housing 3 is pressed against the chamfer 11 and the vertical wall area 12, wherein the seals 25 are resiliently compressed. The restoring force of the seals 25 in turn holds the lower edge of the front wall 33 pressed against the contact area 21. In practice, two screw tabs 37, reinforcement parts 38 and screws 39 are sufficient in each case, in order to ensure a secure retention of the evaporator housing 3.

As a consequence of their oblique orientation and their placement in front of the chamfer 11, the reinforcement parts 38 and the screws 39 find space completely in the intermediate wall between the storage chambers 4 and 5. They only make an insignificant contribution to the thermal conductivity of the body 1 in that they are only exposed to a weak temperature gradient at this location.

As the evaporator chamber 23 is delimited in the lateral direction by the side walls 24 of the evaporator housing 3, the end wall 22 does not need to extend over the entire width of the storage chamber 4, in order to suppress an air exchange between evaporator chamber 23 and storage chamber 4 away from the inlet and outlet 34, 32. Therefore, as can be seen in FIG. 3, part of the vertical wall area 12 of the inner container may be exposed on each side of the evaporator housing 3. It is therefore possible to use one and the same model of evaporator 2 and evaporator housing 3 in refrigeration appliances with different widths of storage chamber 4.

FIGS. 4 and 5 show perspective views of the reinforcement part 38. The reinforcement part 38 contains a cylindrical shaft 40 with radially protruding anchoring wings 41 which engage into the insulation material 8 in the installed state. At one end of the shaft 40, a thin-walled, resilient skirt 42 in the shape of a truncated cone is formed, which in the installed state is in tightly abutting contact with a surface of the inner container 6 facing toward the insulation material 8. The skirt 42 surrounds a bayonet coupling section 43 with a cylindrical core, which in the installed state pushes through an opening of the inner container 6, and retaining webs 44 protruding from the core, which are held pressed against the inner side of the inner container 6 by resilient deformation of the skirt 42.

A cylindrical atrium 45 is formed in the core. A screw hole 46 extends out from a base area of the atrium 45 in the axial direction into the shaft 40.

Figure 6:
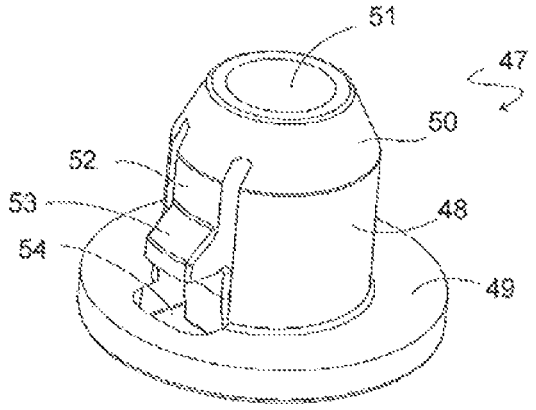
FIG. 6 is a perspective view of a coupling part.
Figure 7:
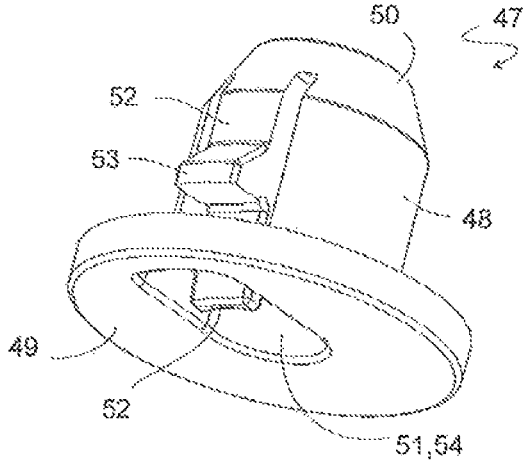
FIG. 7 is a second perspective view of the coupling part.
Figure 8:
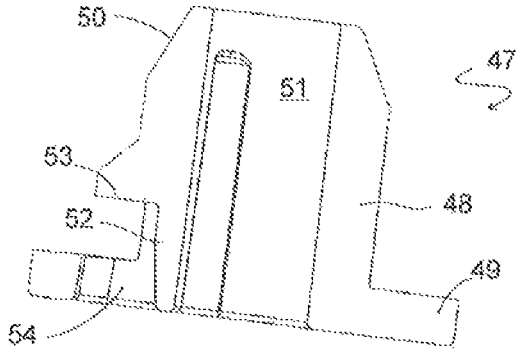
FIG. 8 is a longitudinal sectional view of the coupling part.

FIGS. 6, 7 and 8 show a coupling part 47, in perspective views and in an axial section, respectively. The coupling part 47 contains a hollow cylindrical peg 48, the diameter of which is dimensioned in order to engage into the atrium 45 with little play. Molded at one end of the peg 48 is a flange 49, which protrudes radially over the circumference of the peg 48. There may be provision for an insertion tapering 50 at the opposite end of the peg 48. A through-hole 51 of the coupling part 47 has a larger diameter than the screw hole 46.

A U-shaped slot is left in the wall of the peg 48, in order to form a resiliently deflectable latching tongue 52. A latching lug 53 of the latching tongue 52 protrudes radially over the circumference of the peg. The flange 49 has an elongated opening 54, into which the circular through-hole 51 opens. A free end of the latching tongue 52 engages into the opening 54, so that the latching tongue 52 can be deflected by a tool introduced into the opening 54 to retract the latching lug 53 behind the circumference of the peg 48.

If the evaporator housing 3 is placed in an assembled position, in which the openings 55 of the screw tabs 37 overlap with the atria 45 of the reinforcement parts 38 inserted into the inner container on the cover 10, then evaporator housing 3 is initially provisionally fixed by the peg 48 of a coupling part 47 being introduced through one of the openings 55 into the atrium 45 of one of the reinforcement parts 38. Here, the insertion tapering 50 may serve to correct small alignment errors between screw tab 37 and reinforcement part 38. The coupling part 47 is latched in this position by the latching lug 53 coming into contact at the surface of the inner container 6 facing towards the atrium 45.

The coupling part 47, in conjunction with the lower edge of the front wall 33 in contact with the contact area 21, is sufficient to fix the evaporator housing 3 in the storage chamber 4, but possibly not quite to ensure that the side walls 24 are in tightly abutting contact with the inner container 6. In order to bring about the compression of the seals 25 which is necessary for this, the screw 39 is additionally screwed into the through-hole 51 of the coupling part 47, and in doing so this leads to its tip entering the screw hole 46. If the screw 39 is now rotated, then it penetrates into the screw hole 46 and in doing so pulls the housing 3 against the chamfer 10 and the vertical wall area 12.

FIG. 9 shows part of the inner container 6 of the storage chamber 4 and the contact area 21 formed therein in accordance with a preferred embodiment of the invention. The inner container 6 is shown in a cutaway view along a vertical edge running in the depth direction through the vertical wall area 12 and the upper/front side 13, 14, in order to be able to show the contact area 21 and also the outer sides, which are facing towards the insulation material, of the vertical wall area 12 and the front side 14 in the same view. Part of the condensation drainage groove 19 is apparent, which is sloping towards a central, deepest point, on the right in the view in FIG. 4. The condensation drainage groove 19 is delimited at the front, on a side opposite the vertical wall area 12, by an oblique flank 56 along a majority of its length. Occasionally, the base of the condensation drainage groove 17 forms protrusions 57, which jut out into the oblique flank 56 and are delimited at the front by a contact area 21 in each case.

The fact that projections 58 (see FIG. 10) are formed at the lower edge of the front wall 33 of the evaporator housing 3 at points complementary to the protrusions 57 means that, due to these projections 58 engaging into the protrusions 57 during the assembly of the evaporator housing 3, it is possible for the position thereof in the transverse direction of the body 1 to be unambiguously predefined and, as a result, the width of the regions of the vertical wall area 12, which possibly remain free on the sides of the evaporator housing 3, is specified. Furthermore, with the aid of the projections 58 engaging into the protrusions 57, it can be ensured that screw tabs 61 (see FIG. 10), which are distributed similarly to the screw tabs 37 of the upper edge along a lower edge of the end wall 22, overlap with reinforcement parts 38 in the upper side 13, so that here too a coupling part 47 can be screwed through each screw tab 61 in one of the reinforcement parts 38 and, subsequently, the screw tab 61 can be screwed to the reinforcement part 38 in a fixed manner, as described above.

FIG. 10 shows a lower part of the evaporator housing 3 in a perspective view. The evaporator housing 3 is assembled from two components 59, 60 which are latched together. The front component 59 contains the front wall 33, the projections 58, which protrude at the lower edge of the front wall 33 and are provided to be placed at the contact areas 21 of the inner container 6, screw tabs 61 which protrude forward next to the projections 58 in each case, and also webs 62 which protrude backward along the edges of the front wall 33. Free edges of the webs 62 are in contact with the rear wall 27, which is for the most part covered in FIG. 5, and thus form narrow-sided walls of the distribution chamber 26. The rear wall 27 and the side walls 24 which protrude backward from its lateral edges form the rear component 60. Front and rear component 59, 60 are held together by latching arms 63 of the front component 59, which are in contact with the side walls 24 on the outside in each case and accommodate a latching projection 64 of the side walls 24.

The following is a summary list of reference numerals and the corresponding structure used in the above description of the invention:

1 body
2 evaporator
3 evaporator housing
4 storage chamber
5 normal refrigerator compartment
6 inner container
7 outer membrane
8 insulation material
9 machinery area recess
10 cover
11 chamfer
12 vertical wall area
13 upper side
14 front side
15 base
16 base plate
17 bypass blocker
18 retaining webs
19 condensation drainage groove
20 passage
21 contact area
22 end wall
23 evaporator chamber
24 side wall
25 seal
26 distribution chamber
27 rear wall
28 opening
29 fan
30 outlet
31 duct
32 outlet
33 front wall
34 inlet
35 screen
36 air duct
37 screw tab
38 reinforcement part
38 screw
40 shaft
41 anchoring wing
42 skirt
43 bayonet coupling section
44 retaining web
45 atrium
46 screw hole
47 coupling part
48 peg
49 flange
50 insertion tapering
51 through-hole
52 latching tongue
23 latching lug
54 opening
55 opening
56 oblique flank
57 protrusion
58 projection
59 component
60 component
61 screw tab
62 web
63 latching arm
64 latching projection

The invention claimed is:

1. A refrigeration appliance, comprising:

an inner container delimiting an interior and having an opening formed therein;

a first reinforcement part anchored in said opening of said inner container and having a screw hole formed therein and extending in an axial direction;

at least one coupling part;

a built-in part disposed in said interior and having an opening formed therein, said built-in part fastened by said at least one coupling part pushing through said opening of said built-in part in an axial direction and engaging into said first reinforcement part, said coupling part having a structural element on an external surface of said coupling part for engaging said built in part and axially fixing said connecting part in said opening of said built-in part and preventing movement of said coupling the axial direction;

said first reinforcement part having a side facing toward said interior and on said side facing toward said interior having an atrium, a cross-section of said atrium being greater than that of said screw hole; and said coupling part having a peg, a cross-section of said peg being greater than that of said screw hole and said peg engaging into said atrium.

2. The refrigeration appliance according to claim 1, wherein said coupling part has a through-hole formed therein, and said through-hole is flush with said screw hole when said peg is introduced into said atrium.

3. The refrigeration appliance according to claim 2, further comprising a screw extending through said through-hole and is in engagement with a thread in said screw hole.

4. The refrigeration appliance according to claim 1, wherein said structural element includes a resilient latching tongue formed in said peg.

5. The refrigeration appliance according to claim 1, wherein said coupling part has a flange, a cross-section of said flange being greater than that of said peg.

6. The refrigeration appliance according to claim 1, wherein said inner container contains a first wall area, with which said built-in part is in contact, and a second wall area angled away from said first wall area, to which said first reinforcement part is anchored.

7. The refrigeration appliance according to claim 6, wherein said first wall area and said second wall area form an obtuse angle.

8. The refrigeration appliance according to claim 6, wherein said inner container has a third wall area opposite said second wall area, and said built-in part is in contact with said second and third wall areas.

9. The refrigeration appliance according to claim 8, further comprising a second reinforcement part anchored to said third wall area and said built-in part is also fastened to said second reinforcement part.

10. The refrigeration appliance according to claim 1, wherein said built-in part has a housing of an evaporator chamber.

11. The refrigeration appliance according to claim 10, wherein:

said inner container has a wall region; and said housing has at least one end wall, which extends in parallel with said wall region of said inner container.

12. The refrigeration appliance according to claim 11, wherein said housing has at least one side wall angled away from said end wall, said side wall having an edge facing away from said end wall and is in contact with said inner container.

13. The refrigeration appliance according to claim 12, further comprising a resilient seal compressed between said edge and said inner container.

14. The refrigeration appliance according to claim 11, wherein said opening of said built-in part is formed in a tab protruding from an edge of said end wall.

15. The refrigeration appliance according to claim 1, wherein said container defines a hollow space foamed with insulation, said reinforcement part is disposed in and engages said insulation.

* * * * *